US009544693B2

(12) United States Patent
Deffarges

(10) Patent No.: US 9,544,693 B2
(45) Date of Patent: Jan. 10, 2017

(54) DEVICE FOR EMITTING AN ACOUSTIC WAVE

(75) Inventor: Francois Deffarges, Neuilly sur Seine (FR)

(73) Assignee: NEXO, Plailly (FR)

( * ) Notice: Subject to any disclaimer, the term of this patent is extended or adjusted under 35 U.S.C. 154(b) by 0 days.

(21) Appl. No.: 14/112,043

(22) PCT Filed: Apr. 13, 2012

(86) PCT No.: PCT/FR2012/050824
§ 371 (c)(1),
(2), (4) Date: Oct. 16, 2013

(87) PCT Pub. No.: WO2012/143657
PCT Pub. Date: Oct. 26, 2012

(65) Prior Publication Data

US 2014/0037128 A1 Feb. 6, 2014

(30) Foreign Application Priority Data

Apr. 20, 2011 (FR) ..... 11 53405

(51) Int. Cl.
*H04R 1/00* (2006.01)
*H04R 7/02* (2006.01)
(Continued)

(52) U.S. Cl.
CPC ..... *H04R 7/02* (2013.01); *H04R 1/403* (2013.01); *H04R 7/10* (2013.01); *H04R 7/125* (2013.01);
(Continued)

(58) Field of Classification Search
USPC ..... 381/184, 398, 423
See application file for complete search history.

(56) References Cited

U.S. PATENT DOCUMENTS 4,122,314 A * 10/1978 Matsuda ..... H04R 7/02 181/170
4,239,090 A 12/1980 Dahlquist
(Continued)

FOREIGN PATENT DOCUMENTS

EP 1 178 701 2/2002
GB 2 062 408 5/1981
(Continued)

OTHER PUBLICATIONS

International Search Report dated Aug. 16, 2012, corresponding to PCT/FR2012/050824.
(Continued)

*Primary Examiner* — Amir Etesam
(74) *Attorney, Agent, or Firm* — Young & Thompson

(57) ABSTRACT

A device for emitting an acoustic wave includes a flared structural piece bearing at its base an electromechanical transducer and defining at its flared end an output surface. A mechano-acoustic coupler made of one piece is a solid piece and exhibits: a first portion for mounting on the transducer, a second portion extending from the first portion up to the level of the output surface, the coupler being suspended on the structural piece at the level of the second portion and the second portion having a cross-sectional area at the level of the output surface which is strictly greater than its cross-sectional area at the level of the first portion, and a third portion extending from the second portion, where the third portion has a cross-sectional area which is smaller than the output surface, the third portion including a cross-section of greater area than the output surface.

14 Claims, 5 Drawing Sheets

(51) Int. Cl.

| | |
|---|---|
| ***H04R 1/40*** | (2006.01) |
| *H04R 7/10* | (2006.01) |
| *H04R 7/12* | (2006.01) |
| *H04R 7/16* | (2006.01) |
| *H04R 9/04* | (2006.01) |

(52) U.S. Cl.
CPC ..... *H04R 7/16* (2013.01); *H04R 9/046* (2013.01); *H04R 2201/401* (2013.01)

(56) References Cited

U.S. PATENT DOCUMENTS

| | | | | |
|---|---|---|---|---|
| 4,384,174 | A * | 5/1983 | Suzuki | H04R 7/02 181/170 |
| 4,517,416 | A | 5/1985 | Goossens | |
| 4,620,606 | A | 11/1986 | Suzuki | |
| 6,449,376 | B1 * | 9/2002 | Beltran | H04R 7/04 381/423 |
| 6,839,444 | B2 * | 1/2005 | Ellis | H04R 9/045 381/152 |
| 7,510,048 | B2 * | 3/2009 | Nevill | H04R 7/14 181/174 |
| 2005/0089187 | A1 | 4/2005 | Turnmire | |
| 2009/0141916 | A1 | 6/2009 | Clair et al. | |
| 2010/0172537 | A1 * | 7/2010 | Campbell | H04R 7/20 381/423 |

FOREIGN PATENT DOCUMENTS

| | | |
|---|---|---|
| JP | S54-18722 | 2/1979 |
| JP | 55 011680 | 1/1980 |
| JP | S56-53896 | 5/1981 |
| JP | S60-223400 | 11/1985 |
| JP | S61-103395 | 5/1986 |

OTHER PUBLICATIONS

CN Office Action, dated Dec. 1, 2015; Application No. 201280019386.X.

JP Office Action, dated Nov. 17, 2015; Application No. 2014-505698.

* cited by examiner

DEVICE FOR EMITTING AN ACOUSTIC WAVE

BACKGROUND OF THE INVENTION

Field of the Invention

The invention relates to a device for emitting an acoustic wave, such as a loudspeaker.

Description of Related Art

Use is currently made of devices for emitting an acoustic wave comprising a flared structural piece (or frame) which bears at its base an electromechanical transducer (including for example a coil) and which defines at its flared end an output surface.

A membrane linked to the transducer is then generally mounted suspended inside the structural piece (i.e. on the same side of the output surface as the transducer). The membrane is caused to vibrate by the transducer and thus emits an acoustic wave (in the case in point, through the output surface).

When devices produced according to this design are juxtaposed, it is not possible to obtain a continuous emitting surface owing to the fact that the space required for the structural pieces (or frames) is greater than that for each membrane; the membranes of the different devices are therefore themselves not contiguous.

In order to improve this state of affairs, U.S. patent application 2009/141 916 proposed a design according to which a radiating diaphragm is mounted at the end of a cylindrical coil former. This design therefore does not include the flared structural piece (or frame) conventionally used, as the patent application in fact emphasises.

It may be desirable for different reasons, in particular in order to avoid a specific development and to turn on the other hand to a piece of proven design, to continue to use a flared structural piece. It is thus sought in particular to propose a design which allows for the juxtaposition of the emitting surfaces of different emission devices without calling the use of a flared structural piece into question.

BRIEF SUMMARY OF THE INVENTION

With this aim in particular, the invention proposes a device for emitting an acoustic wave comprising a flared structural piece bearing at its base an electromechanical transducer and defining at its flared end an output surface, characterized by a single-piece mechanical-acoustic coupler and exhibiting:

- a first portion for mounting on the transducer,
- a second portion extending from the first portion up to the level of the output surface, the coupler being suspended on the structural piece at the level of the second portion and the second portion having a cross-sectional area at the level of the output surface which is strictly greater than its cross-sectional area at the level of the first portion, and
- a third portion extending from the second portion, where the third portion has a cross-sectional area which is smaller than the output surface, the third portion comprising a cross section of greater area than the output surface. The coupler is moreover a solid piece.

Such a device makes it possible to use a traditional flared structural piece, of the frame type, and to juxtapose several emission devices to form a continuous emitting surface (thanks to the cross-sectional area greater than the output surface).

A particularly effective mechanical-acoustic coupler is thus also defined.

The coupler may also exhibit an emitting surface at the level of the third portion. This emitting surface is for example flat or cylindrical. The juxtaposition of devices having flat, respectively cylindrical, emitting surfaces, makes it possible easily to obtain a continuous flat, respectively cylindrical, emitting surface (formed by the emitting surfaces of the devices meeting together). Other forms of emitting surface may also be envisaged, such as for example a spherical emitting surface.

End parts of the third portion opposite the second portion (or end regions of the emitting surface) are for example free and can thus be vibrated by the transducer.

The coupler exhibits for example a homogeneous density in its volume. There could, however, be a variant whereby the third portion exhibits a density different from the density of the second portion.

The second portion exhibits for example rotational symmetry. As a variant, the second portion could be symmetrical with respect to each of two planes essentially parallel to the axis of emission of the device (axis along which the first, second and third portions follow each other). According to another variant, the second portion could not exhibit symmetry.

The coupler has for example a density of less than 110 $kg/m^3$ (and/or greater than 32 $kg/m^3$), i.e. typically comprised between 32 $kg/m^3$ and 110 $kg/m^3$. The coupler can thus be driven (by the transducer) in good conditions despite its volume being greater than that of a membrane.

The coupler is for example produced from at least one material exhibiting a Young's modulus of elasticity greater than 36 MPa and/or less than 160 MPa, or typically comprised between 36 MPa and 160 MPa.

The coupler is for example produced from at least one material exhibiting a shear modulus greater than 13 MPa and/or less than 50 MPa, i.e. typically comprised between 13 MPa and 50 MPa.

The coupler is for example produced from at least one material exhibiting a Poisson's ratio greater than 0.2 and/or less than 0.3, i.e. typically comprised between 0.2 and 0.3.

The coupler is for example produced from at least one watertight material.

These features of the material of the coupler make it possible to obtain beneficial performances from the acoustic point of view.

When the coupler is suspended on the structural piece at the level of the second portion by means of a first suspension, the coupler can also be suspended on the structural piece by means of a second suspension which is distinct from the first suspension. This second suspension may be done by means of another element such as the coil support.

BRIEF DESCRIPTION OF THE DRAWINGS

Other features and advantages of the invention will become more apparent on reading the following description, with reference to the attached drawings in which.

DETAILED DESCRIPTION OF THE PREFERRED EMBODIMENTS

Figure 1:
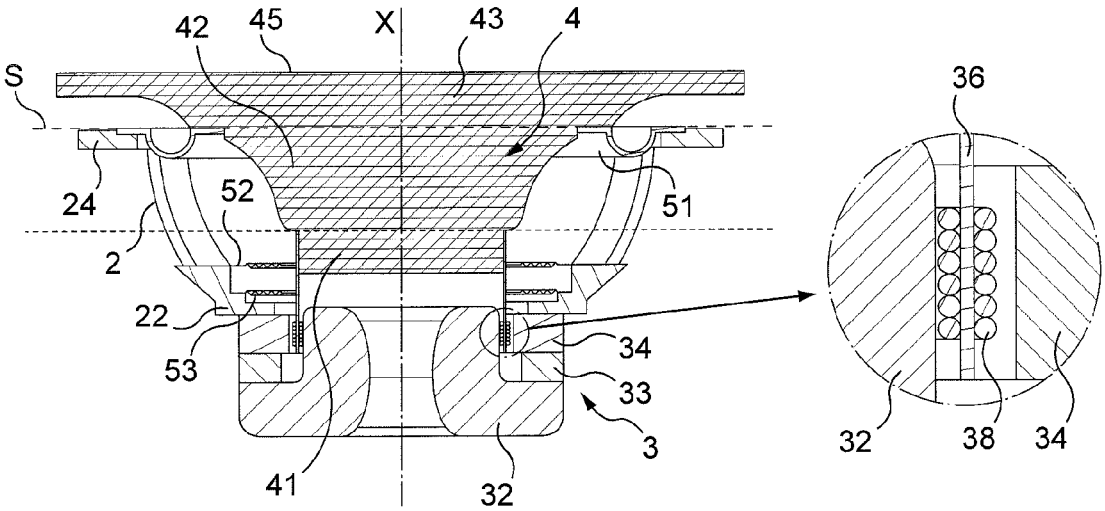
FIG. 1 represents a cross-sectional view of a loudspeaker according to a first embodiment of the invention.

The loudspeaker represented in FIGS. 1 and 2 comprises a flared structural piece or frame 2, having a generally cylindrical shape with rotational symmetry about an axis X of the loudspeaker (which corresponds, as explained hereinafter, to the main direction of emission of acoustic waves by the loudspeaker).

The frame thus exhibits a base 22, which corresponds to the end of the frame 2 along axis X at the level of which the frame 2 exhibits the smallest cross-sectional size perpendicular to axis X.

The frame 2 exhibits, at its flared end 24 opposite the base 22 along axis X, an output surface S (for example flat) the surface area of which (still in cross section perpendicular to axis X) is therefore greater than the cross-sectional area of the base 22.

At the level of the base 22 of the frame 2, an electromechanical transducer 3 is mounted, which comprises a first piece made from soft iron 32, a second piece made from soft iron 34 and a magnet 33. These three elements are fixed with respect to one another and with respect to the frame 2.

The electromechanical transducer also comprises a coil former 36 on which a coil 38 is mounted.

The first soft iron piece 32 comprises a first cylindrical part having an overall dimension (in cross section perpendicular to axis X) identical to the overall dimension of the magnet 33 and of the second soft iron piece 34. It is noted in this respect that the magnet 33 and the second soft iron piece 34 are produced in an annular shape about axis X.

The first soft iron piece 32 also comprises a second part exhibiting an overall dimension in cross section (perpendicular to axis X) less than that of the first part; the second part is received inside the annular magnet 33 and the second annular piece 34. In other words, the internal diameter of the annular pieces 33, 34 is greater than the external diameter of the second part of the first piece 32, which makes it possible to arrange an annular space in which the coil 38 borne by the coil support 36 is received.

Thus, the passage of a current of variable intensity in the coil 38 allows it and consequently the coil support 36 to be driven in movement with respect to the pieces 32, 34 and thus with respect to the frame 2.

The coil former 36 here exhibits the shape of a right cylinder and bears, at the end (along axis X) of the cylinder opposite the end bearing the coil 36, a mechanical-acoustic coupler 4 here formed from a solid piece made from ROHACELL.

The coupler 4 exhibits three portions which extend successively along axis X:

- a first portion 41, here produced in the shape of a right cylinder with an external diameter identical to the internal diameter of the coil support 36 so as to allow the coupler 4 to be mounted on the coil support 36;
- a second portion 42 extending from the first portion 41 and up to the level of the output surface S of the frame 2;
- a third portion 43 extending from the second portion 42 (at the level of the output surface S) up to an emitting surface 45, which is flat and generally rectangular in the present embodiment.

In the example described here, the three portions are produced from the same homogeneous material as indicated above and the coupler thus exhibits a homogeneous density in its volume.

It may be envisaged as a variant that each portion is produced from a specific material.

The coupler 4 is suspended on the frame 2 at the level of its second portion 42 by means of a first suspension 51. This first suspension 51 is produced here in the form of an annular resilient piece (about axis X) mounted in the example in FIG. 1 between the flared end 24 of the frame 2 and the second portion 42 of the coupler 4.

The coupler 4 is, on the other hand, not connected (either by a suspension or by a rigid fixing) to the structure of the loudspeaker at the level of its third portion 43. In particular, the end regions of the emitting surface 45 (which extend here over the entire circumference of the emitting surface 45), i.e. the end parts of the third portion 43 positioned opposite the second portion 42, are free. These end regions are therefore vibrated by the transducer.

It is also noted that, in the present embodiment, the assembly formed by the coil former 36 and the coupler 4 is also suspended on the frame 2 at the level of the coil former 36 by means of two annular suspensions (or "spiders") 52, 53.

In the embodiment described, the second portion 42 exhibits a rotational symmetry about axis X. Other forms may, however, be envisaged.

As already indicated, the third portion 43 extends from the second portion 42 (i.e. from the output surface S) up to the emitting surface 45. As is clearly visible in the figures, the emitting surface 45 exhibits a cross-sectional area at least equal to the maximum overall dimension in cross section of the frame and thus greater than the output surface S.

Thus, the surface area of the third portion 43 in cross section passes from a value less than the output surface S (at the level of this output surface where the coupler 4 is still received inside the frame 2) to a value greater than the output surface area S (in particular at the level of the emitting surface 45, as indicated above). This is possible owing to the fact that the third portion 43 extends (forwards) outside the frame, i.e. in the opposite direction to the transducer 3 with respect to the output surface.

Figure 2:
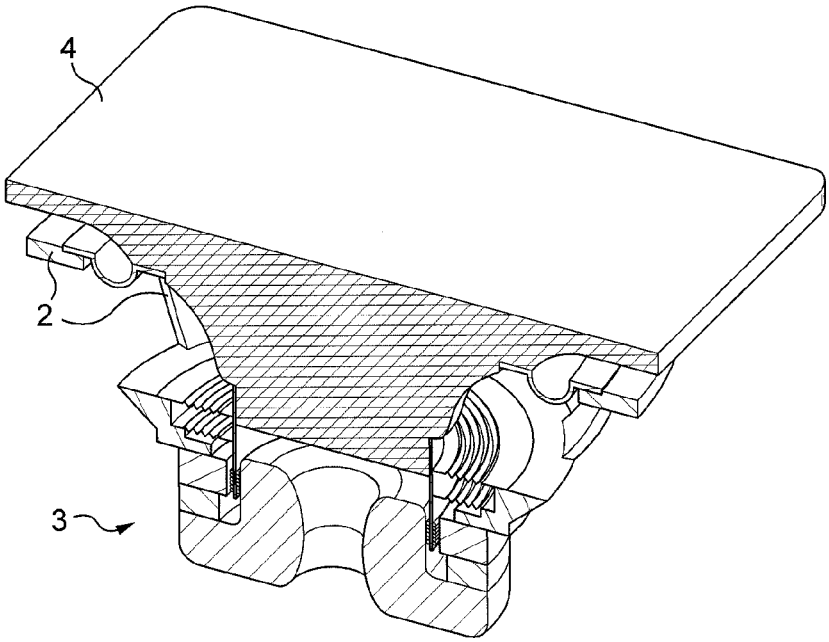
FIG. 2 represents a perspective view of the loudspeaker in FIG. 1.
Figure 5:
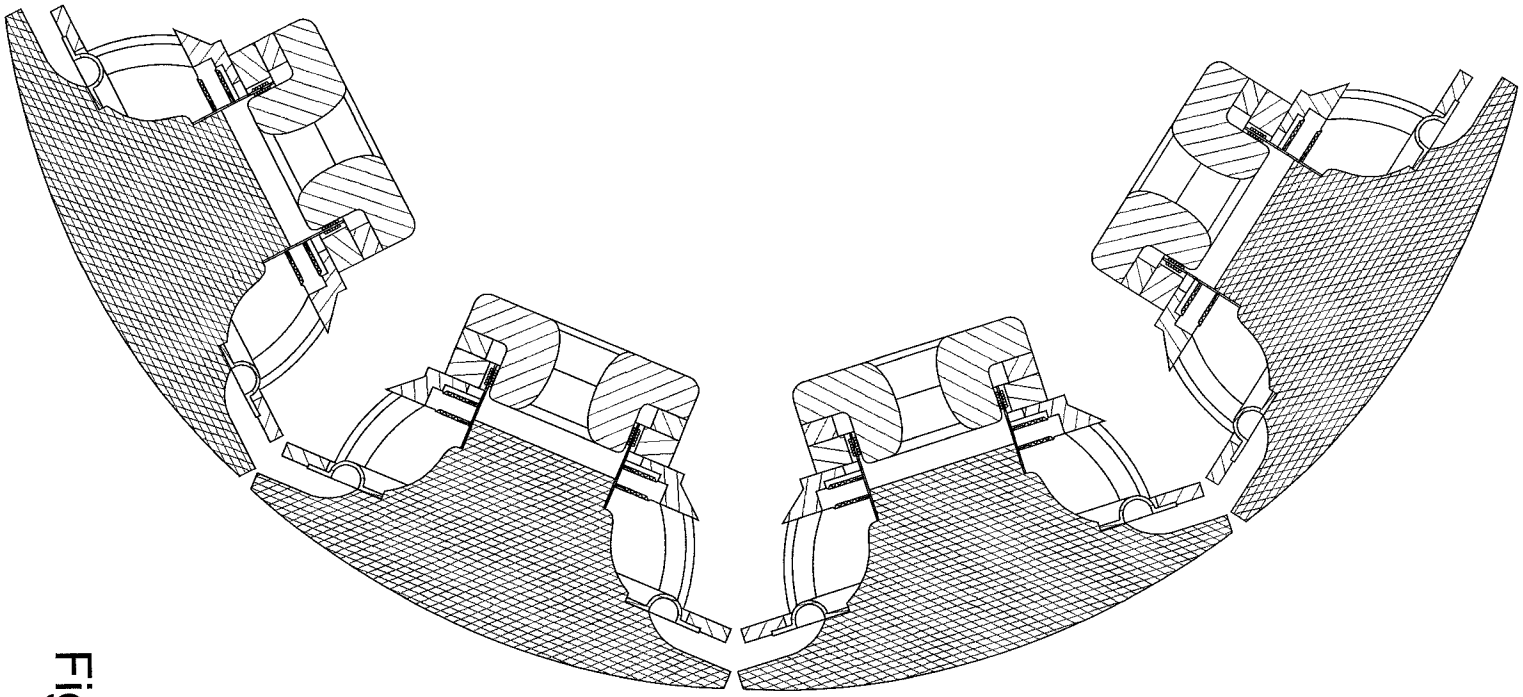
FIG. 5 represents a first possibility for juxtaposition of a plurality of loudspeakers each conforming to FIGS. 3 and 4.
Figure 6:
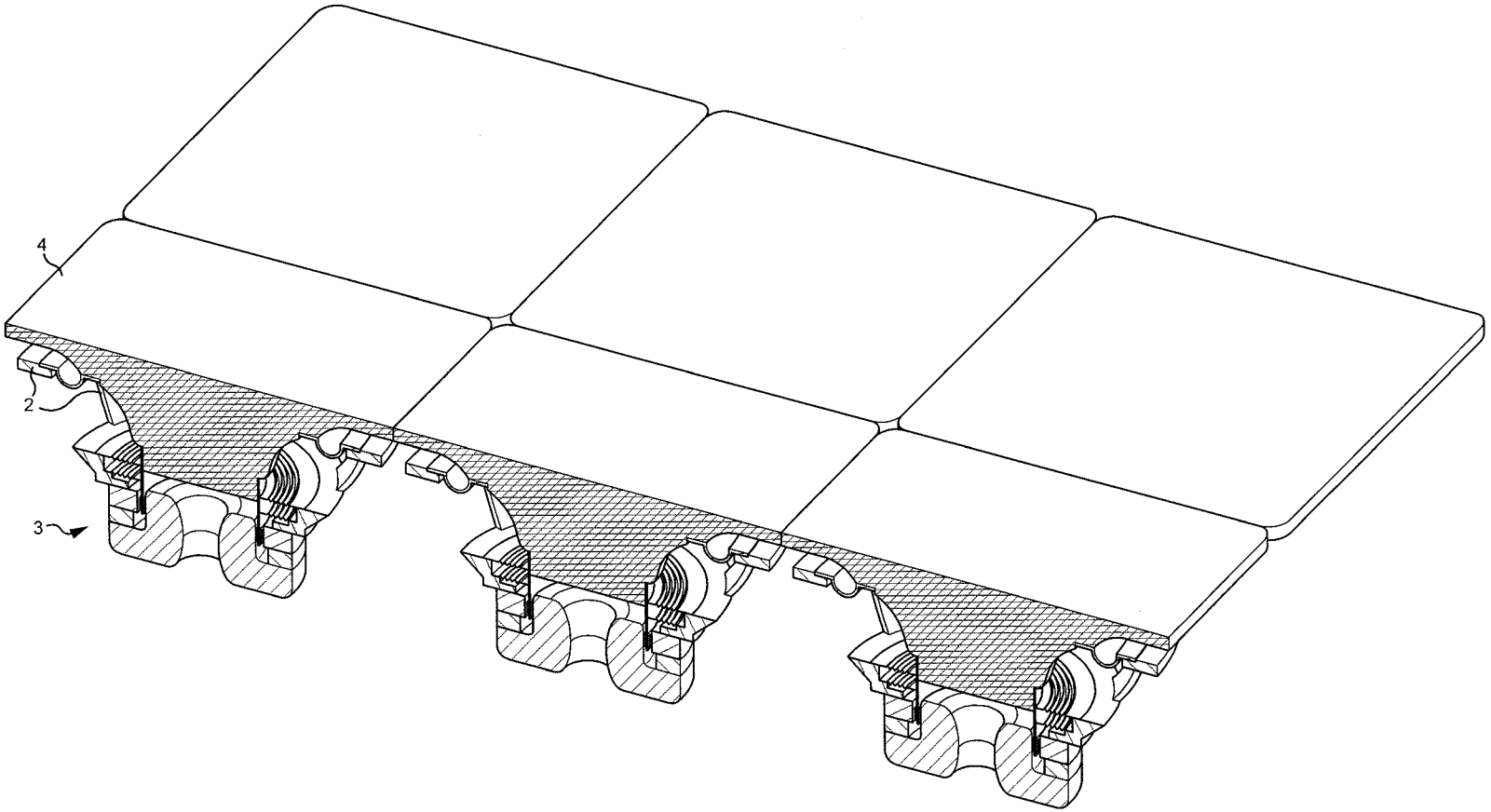
FIG. 6 represents a possibility for juxtaposition of a plurality of loudspeakers each conforming to FIGS. 1 and 2.

Thus, when using several loudspeakers of the type of those in FIGS. 1 and 2, the loudspeakers can be arranged so that their respective emitting surfaces are contiguous and thus define together a continuous acoustic emitting surface, here flat, as represented for example in FIG. 5.

Figure 3:
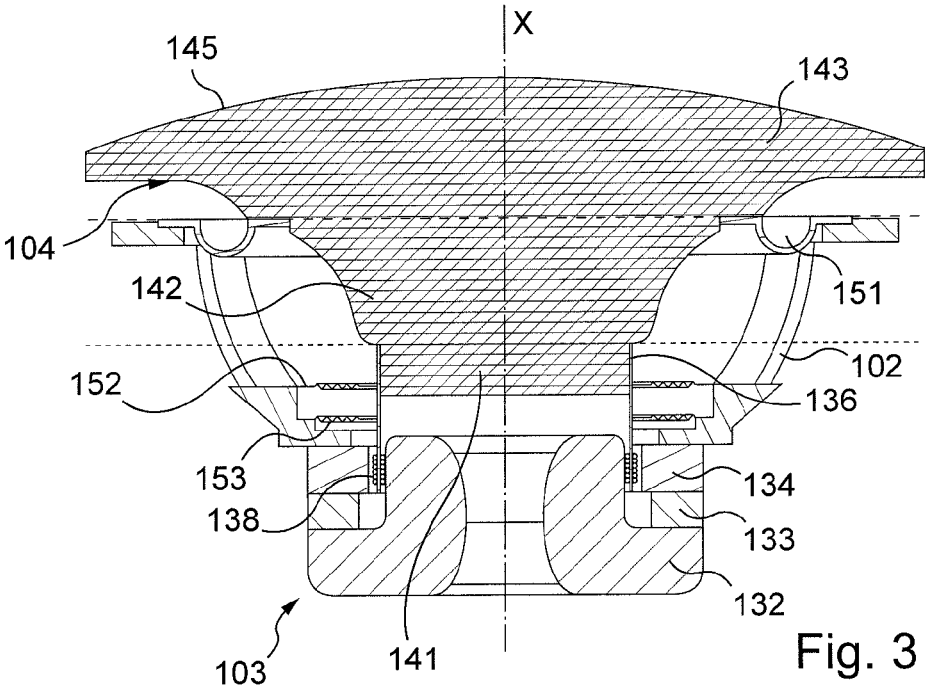
FIG. 3 represents a cross-sectional view of a loudspeaker according to a second embodiment.
Figure 4:
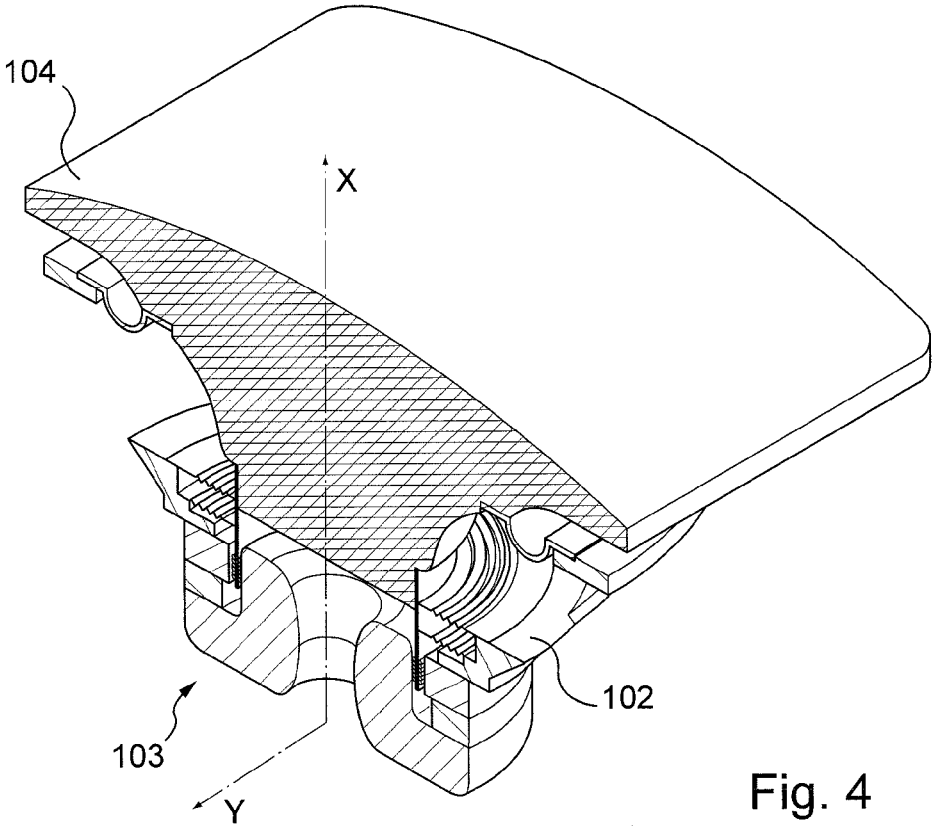
FIG. 4 shows a perspective view of the loudspeaker in FIG. 3.

FIGS. 3 and 4 represent a second embodiment of the invention.

The loudspeaker in FIGS. 3 and 4 comprises elements similar to those of the loudspeaker in FIGS. 1 and 2 and it is therefore not necessary to describe these elements again in detail.

Reference may be made to the description just given for FIGS. 1 and 2, increasing the references by 100.

The loudspeaker in FIGS. 3 and 4 is distinguished from that in FIGS. 1 and 2 by the shape of its emitting surface 145: the third portion 143 of the coupler 4 exhibits an emitting surface 145 having the shape of a portion of right cylinder with axis Y perpendicular to axis X of the loudspeaker.

As for the loudspeaker in FIGS. 1 and 2, the emitting surface 145 also exhibits in cross section perpendicular to axis X a general rectangular shape and its end regions are free.

Figure 7:
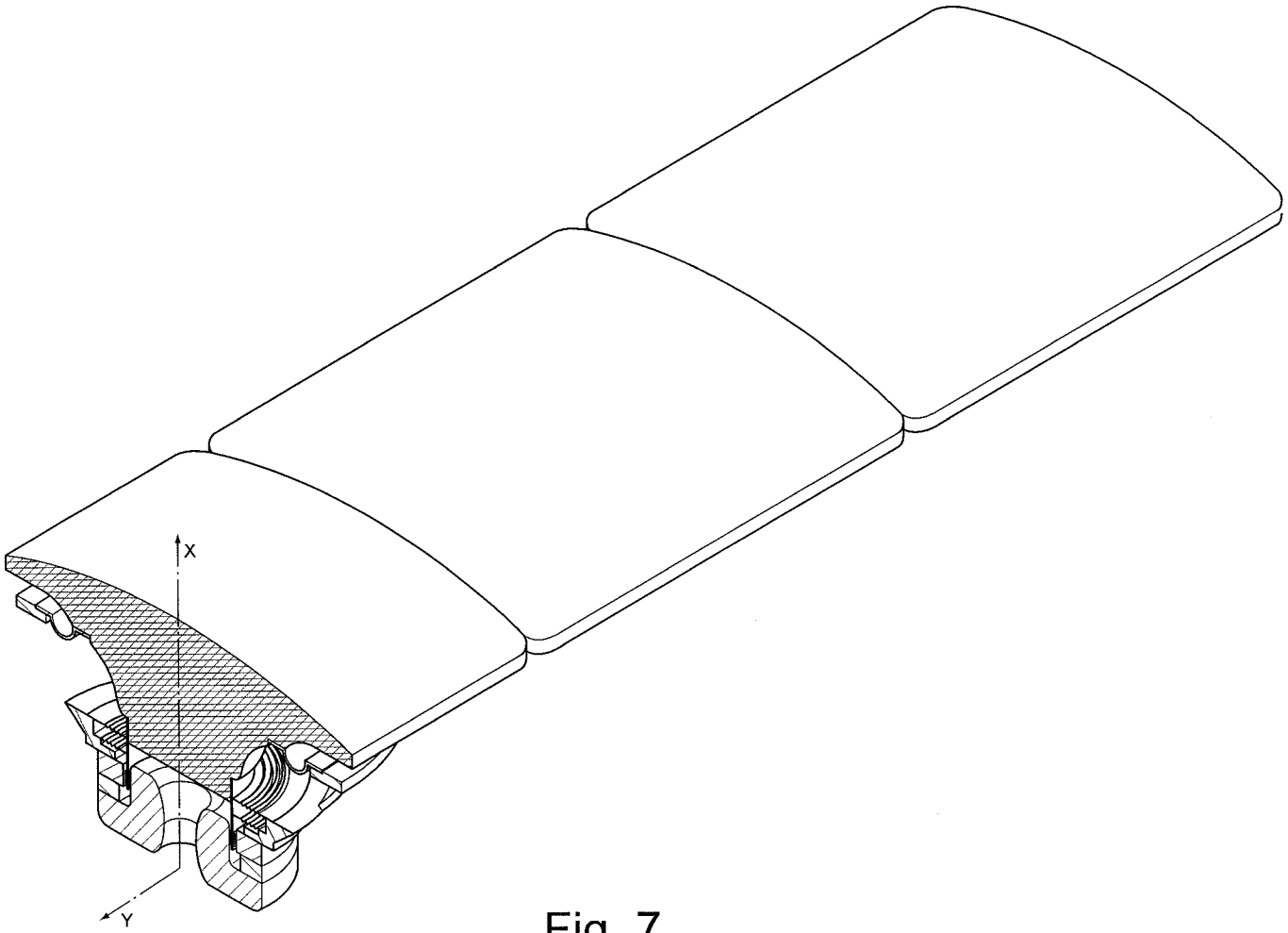
FIG. 7 represents a second possibility for juxtaposition of a plurality of loudspeakers each conforming to FIGS. 3 and 4.

Thus, it is possible, by using several loudspeakers of the type of those presented in FIGS. 3 and 4, to arrange them so that their emitting surfaces are contiguous and thus together define a continuous acoustic emitting surface which is cylindrical in shape. Two distinct examples of such juxtapositions of loudspeakers are presented respectively in FIG. 5 (where the loudspeakers are arranged in an arc of a circle about axis Y of the cylinder) and in FIG. 7 (where the loudspeakers are aligned parallel to axis Y of the cylinder). These two types of juxtaposition may also be combined to form a cylindrical wall of loudspeakers.

It could also be envisaged that the emitting surface exhibited by the third portion of the coupler is spherical, thus making it possible to obtain, by the juxtaposition of several emitting surfaces of different loudspeakers, a continuous spherical emitting surface.

The preceding embodiments are only possible examples for the implementation of the invention, which is not limited thereto.

The invention claimed is:

1. A device for emitting an acoustic wave comprising:

a flared structural piece bearing at its base an electromechanical transducer, the perimeter of its flared end defining an output surface; and a single-piece mechanical-acoustic coupler, the coupler being a solid piece and comprising:

a first portion for mounting on the transducer, a second portion extending from the first portion up to the level of the output surface, the coupler being suspended on the structural piece at the level of the second portion and the second portion having a cross-sectional area at the level of the output surface which is strictly greater than its cross-sectional area at the level of the first portion, and a third portion extending from the second portion, where the third portion has a cross-sectional area at the interface with the second portion which is smaller than the output surface, the third portion comprising a cross section at an emitting surface of greater area than the output surface, wherein when said emission device is juxtaposed together with a plurality of emission devices for emitting an acoustic wave, a continuous emitting surface is formed between all of the emitting surfaces of the juxtaposed emission devices.

2. The emission device according to claim 1, wherein said emitting surface of the emission device is at the level of the third portion.

3. The emission device according to claim 2, wherein the emitting surface of the emission device is flat.

4. The emission device according to claim 2, wherein the emitting surface of the emission device is cylindrical.

5. The emission device according to claim 1, wherein end parts of the third portion opposite the second portion are free.

6. The emission device according to claim 1, wherein the coupler exhibits a homogeneous density in its volume.

7. The emission device according to claim 1, wherein the third portion exhibits a density different from the density of the second portion.

8. The emission device according to claim 1, wherein the second portion exhibits rotational symmetry.

9. The emission device according to claim 1, wherein the coupler has a density comprised between 32 $kg/m^3$ and 110 $kg/m^3$.

10. The emission device according to claim 1, wherein the coupler is produced from at least one material exhibiting a Young's modulus of elasticity comprised between 36 MPa and 160 MPa.

11. The emission device according to claim 1, wherein the coupler is produced from at least one material exhibiting a shear modulus comprised between 13 MPa and 50 MPa.

12. The emission device according to claim 1, wherein the coupler is produced from at least one material exhibiting a Poisson's ratio comprised between 0.2 and 0.3.

13. The emission device according to claim 1, wherein the coupler is produced from at least one watertight material.

14. The emission device according to claim 1, wherein the coupler is suspended on the structural piece at the level of the second portion by a first suspension, and the coupler is suspended on the structural piece by a second suspension which is distinct from the first suspension.

* * * * *